US005966959A

United States Patent [19]

Stewart

[11] Patent Number: 5,966,959

[45] Date of Patent: Oct. 19, 1999

[54] CONDENSATE DRAIN PAN ARRANGEMENT WITH POSITIVE SLOPE

[75] Inventor: Jeffrey L. Stewart, Whitehouse, Tex.

[73] Assignee: American Standard Inc., Piscataway, N.J.

[21] Appl. No.: 09/036,803

[22] Filed: Mar. 9, 1998

[51] Int. Cl.[6] ..... F25D 21/14

[52] U.S. Cl. ..... 62/285; 62/286; 62/288; 62/291

[58] Field of Search ..... 62/285, 286, 288, 62/291

[56] References Cited

U.S. PATENT DOCUMENTS

| | | | |
|---|---|---|---|
| 4,474,232 | 10/1984 | Wright et al. | 165/137 |
| 4,597,269 | 7/1986 | Kim | 62/286 |
| 5,071,027 | 12/1991 | Sullivan | 220/571 |
| 5,481,886 | 1/1996 | Hasegawa et al. | 62/285 |
| 5,511,386 | 4/1996 | Russ et al. | 62/285 |
| 5,664,430 | 9/1997 | Karman | 62/285 |

*Primary Examiner*—Henry Bennett
*Assistant Examiner*—Melvin Jones
*Attorney, Agent, or Firm*—William J. Beres; William O'Driscoll; Peter D. Ferguson

[57] ABSTRACT

A condensate drain pan arrangement with a positive slope. The drain pan arrangement comprises a housing including a first wall with a first aperture, a second wall with a second aperture where the first and second walls are spaced; a coil located in the space in the housing and between the first and second walls; and a drain pan having a condensate receiving portion within the housing and located under the coil. The drain pan includes a first end cap with a drainage attachment proximal the first aperture and positively engaged to the first wall, and a second end cap proximal the second aperture. The second end cap includes an engagement portion and a bottom portion. The drain pan arrangement includes an access plate including a lifting portion operably engaged to the bottom portion and raising same predetermined amount, and a securing portion operably engaged with the engagement portion to prevent movement of the second end cap, the second end cap is fixed with relation to the second wall.

17 Claims, 3 Drawing Sheets

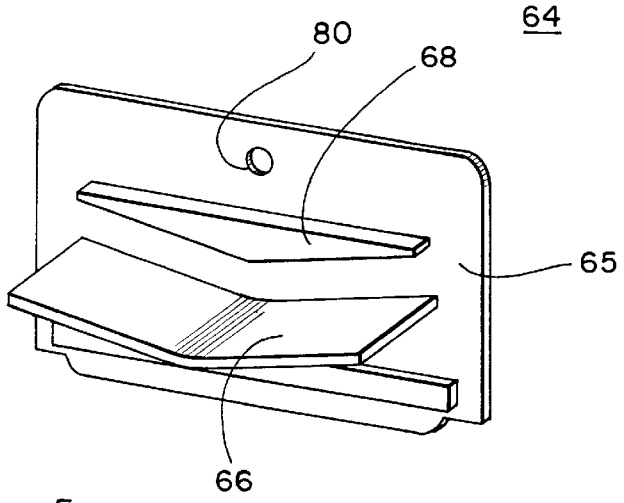
FIG. 5
FIG. 4
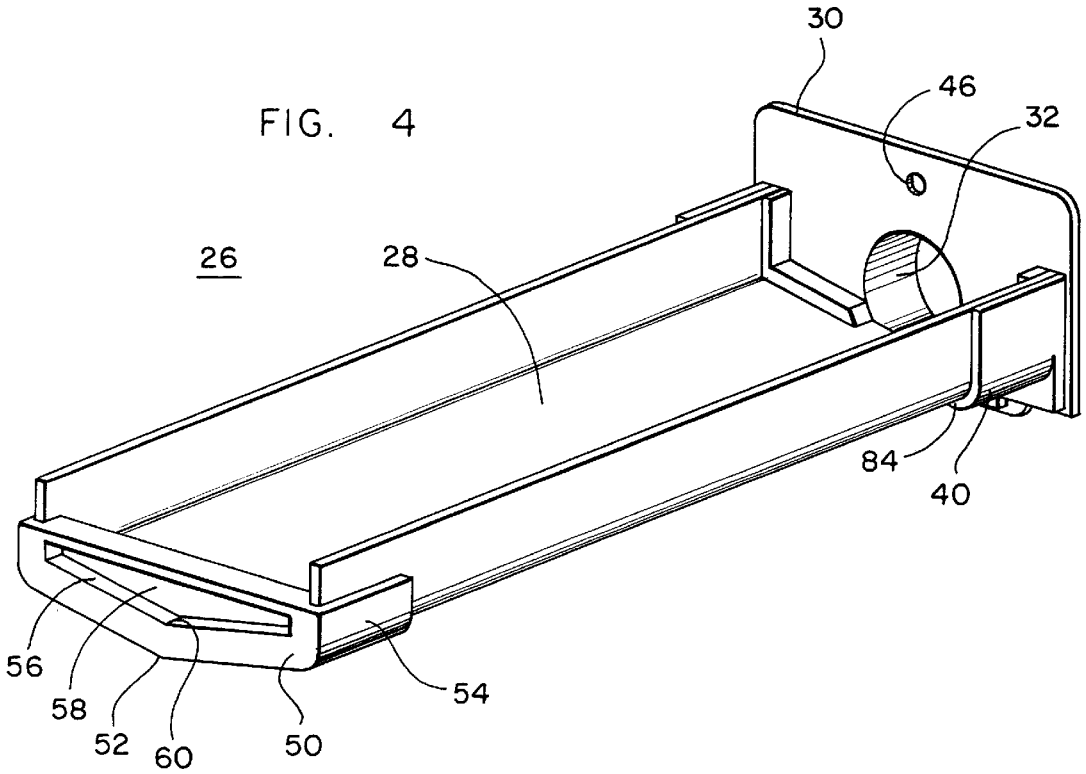

CONDENSATE DRAIN PAN ARRANGEMENT WITH POSITIVE SLOPE

BACKGROUND OF THE INVENTION

The present invention is directed to a condensate drain pan arrangement for an air conditioning unit where the drain pan is positively sloped and easily removable for enhanced indoor air quality.

More specifically, an air handler for comfort conditioning performs latent cooling and includes a drain pan for catching and removing condensate. The condensate is removed to a location where it can be disposed of without allowing the condensate to initiate or enhance the growth of micro-organisms. Typically, drain pans are fixed or a permanent part of an air handler design and cannot be removed without major disassembly of the air handler. Furthermore, the drain pans are often difficult to access for cleaning of the drain pan surface. Moreover, to effectively drain the condensate, the drain pan should be positively sloped towards the drain pan exit point so that the condensate will naturally drain there for removal by a condensate line connected to the drain pan exit point.

Additionally, previous air handler designs had a drain pan with condensate connections at both ends of each pan and required a drain pan for each of the potential coil positions depending on how that coil was applied. In these previous designs, the air handler included two fixed drain pans, only one of which was used. Furthermore, each drain pan had a condensate line at each end of the drain pan to allow drainage from either end of the unit, only one of these condensate line connections being used. Thus prior designs had two pans and four connection points, only one pan and only one connection point of which were used. The remaining three connection points were plugged.

SUMMARY OF THE INVENTION

It is an object, feature and advantage of the present invention to provide a drain pan which addresses the problems of the prior art.

It is an object, feature and advantage of the present invention to provide a removable drain pan with positive slope.

It is a further object, feature and advantage of the present invention to provide a drain pan constructed of plastic for corrosion resistance and having a profile that slopes on both sides towards the middle of the drain pan.

It is an object, feature and advantage of the present invention to provide an easily cleanable drain pan.

It is a further object, feature and advantage of the present invention to provide a removable drain pan which is securely fastened in place during normal operation.

It is an object, feature and advantage of the present invention to provide an air handler with only a single drain pan, rather than the previous designs which require a drain pan for each of the previous multiple positions.

It is an object, feature and advantage of the present invention to provide a condensate drain pan for an air handler where the condensate drain pan has only a single condensate line connection.

The present invention provides a condensate drain pan arrangement with a positive slope. The drain pan arrangement comprises a housing including a first wall with a first aperture, a second wall with a second aperture where the first and second walls are spaced; a coil located in the space in the housing and between the first and second walls; and a drain pan having a condensate receiving portion within the housing and located under the coil. The drain pan includes a first end cap with a drainage attachment proximal the first aperture and positively engaged to the first wall, and a second end cap proximal the second aperture. The second end cap includes an engagement portion and a bottom portion. The drain pan arrangement also includes an access plate including a lifting portion operably engaged to the bottom portion and raising same predetermined amount, and a securing portion operably engaged with the engagement portion to prevent movement of the second end cap. The second end cap is fixed with relation to the second wall.

The present invention also provides a method of installing a drain pan to provide a positive draining slope. The method comprises the steps of: sliding a drain pan into a housing through a first aperture; engaging a first end cap of the drain pan to the housing such that the first end cap covers the aperture and secures the drain pan to the housing; initially engaging an access plate to a second end cap of the drainage pan through a second aperture in the housing; engaging the access plate with the second end cap in a manner to make the second end caps vertical movements depend upon the access plates vertical movements; raising the access plate and the second end cap plate as a unit to provide a positive slope to the drain pan; and securing the access plate to the housing so that the access plate blocks the second aperture.

The present invention further provides an access plate. The access plate comprises a vertical face; a securing portion projecting laterally from the face in a first direction; and a bottom portion projecting from the face in the first direction.

BRIEF DESCRIPTION OF THE DRAWINGS

FIG. 4 is a perspective view of the drain pan of FIGS. 1 and 2.

FIG. 5 is a perspective view of the access plate of FIG. 3.

DETAILED DESCRIPTION OF THE DRAWINGS

Figure 1:
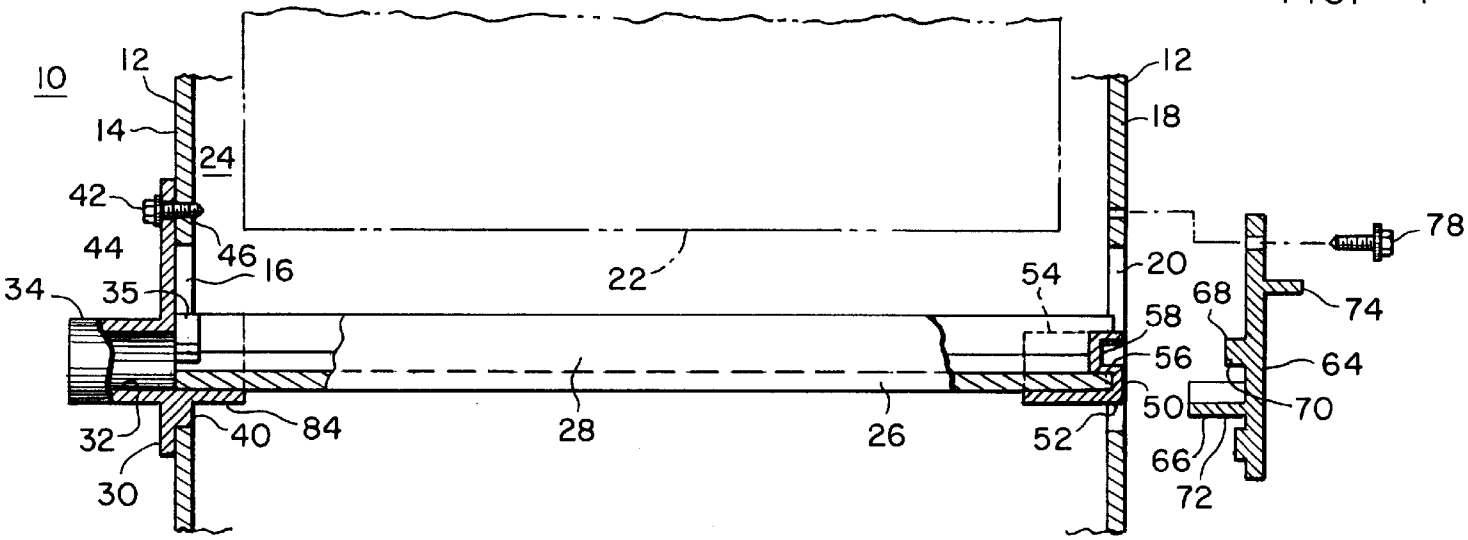
FIG. 1 is side view of the present invention showing the drain pan and access plate just prior to initial engagement.
Figure 2:
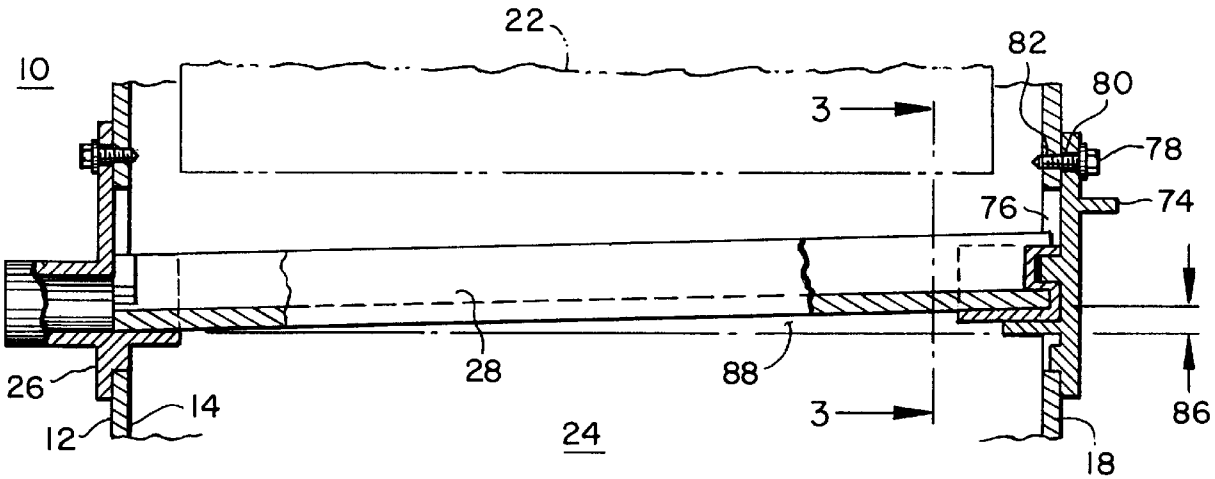
FIG. 2 is a side view of the present invention showing the access plate and drain pan in the final assembly.

The present invention is directed to a condensate drain pan arrangement 10. The condensate drain pan arrangement 10 includes a housing 12 including a first wall 14 having a first aperture 16 and a second wall 18 having a second aperture 20. A conventional air conditioning coil 22 is located in the space 24 between the first wall 14 and the second wall 18.

The drain pan arrangement 10 also includes a drain pan 26 having a condensate receiving portion 28 located under the coil 22 and adapted to receive condensate draining from the coil 22. The drain pan 26 includes a first end cap 30 with a drain aperture 32 and a draining attachment 34 adapted for connection to a conventional condensate line. The first end cap 30 is connected to the condensate receiving portion 28 preferably by sonic welding. The condensate receiving portion is a molded plastic, and the end caps are injected molded. The first end cap 30 includes a flange 40 to position and maintain it on the first end wall 14. The first end cap 30 is operatively affixed in place to the first wall 14 by any conventional means including fasteners, latches, hooks or other conventional fastening arrangements. In the preferred embodiment, the first end cap 30 is attached to the first end wall 14 by a screw 42 conventionally affixed through apertures 44 and 46 in the end cap 30 and first wall 14 respectively.

Figure 3:
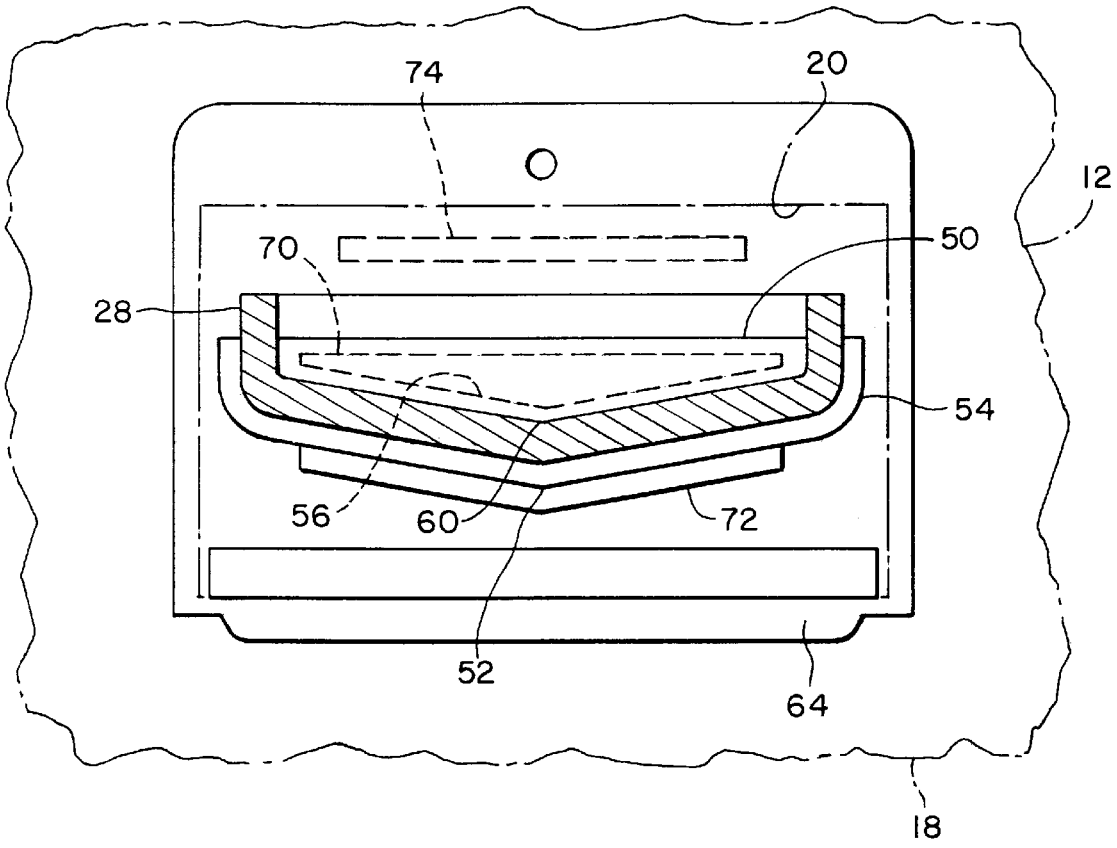
FIG. 3 is a view taken along line 3—3 of FIG. 2 showing the end cap and access plate of the present invention in engagement.

The drain pan 26 also includes a second end cap 50 located proximal the second aperture 20. The second end cap 50 has a bottom portion 52 which may rest on the second end wall 18 at initial engagement. The second end cap 50 includes a connection portion 54 engaged to the condensate receiving portion 28 preferably by sonic welding as discussed above. The second end cap 50 also includes an engagement portion 56 which preferably is an intrusion or indentation 58 extending into the second end cap 50 in a lateral direction toward the condensate receiving portion 28. In the preferred embodiment as shown in FIG. 3, this protrusion has a broad V or arrow shape with a downwardly directed point 60.

The drain pan arrangement 10 also includes an access plate 64 having a face 65 adapted to cover and seal the aperture 20 upon final engagement. The access plate 64 includes a lifting portion 66 adapted to engage the bottom 52 of the second end cap 50 at initial engagement. The access plate 64 also includes a securing portion 68 which is preferably a broad v or arrow shaped extrusion or protrusion 70 to fit into and matingly engage with the intrusion 58. As shown in FIG. 3, this protrusion 70 is vertically arranged to engage the engagement portion 58 including at the V point 60. With the securing portion 68 preventing vertical upward movement due to its engagement with the engaging portion 58 and with the lifting portion 66 engaging the bottom 52 so as to prevent downward vertical movement, the access plate 64 and the second end cap 50 are securely fixed together so as to move as a unit. The lifting portion 66 is preferably a v shaped ledge 72 formed as a protrusion or extrusion to match the bottom 52.

The access plate 64 includes an external handle 74 so that the access plate together with the end cap 50 may be lifted vertically such that a top portion 76 of end cap 50 nears or engages the second end wall 18. The access plate is then securably affixed to the second end wall 18. This is preferably accomplished by any conventional fastening arrangement such as a screw 78 extending through apertures 80 and 82 in the access plate 64 and second end wall 18 respectively.

Upon the initial insertion of the drain pan 26, into the housing 12, the bottom 52 of the second end cap 50 is approximately the same vertical height as the bottom 84 of the first end cap 30. After the access plate 64 and second end cap 50 are lifted as a unit, the bottom 52 of the second end cap 50 is a predetermined distance 86 higher than the bottom 84 of the first end cap 30. This results in a positive slope from the second end cap towards the first end cap and out the aperture 32 as shown by angle 88.

In operation, the drain pan is slid into the housing 12 through the first aperture 16 such that the first end cap 30 is located proximal the first aperture 16 and the second end cap 50 is located proximal the second aperture 20. Preferably the bottom 84 of the first end cap 30 rests on the first wall 14 and the bottom 52 of the second end cap 50 may rest on the second wall 18. The first end cap 30 is then secured in place by fastener 42 to complete the initial insertion step. The access plate 64 is then brought into initial engagement with the second end cap 50 such that the lifting portion 66 is below the bottom 52 and the securing portion 68 is operably engaged with the engagement portion 56. The access plate is then lifted into final position to create the positive slope 88, and secured in place with fastener 78.

What has been described is a method and apparatus for installing a condensate drain pan and providing a positive slope. It will be apparent to a person of ordinary skill in the art that many alternatives and modifications can be made in this arrangement. Such modifications and arrangements include variations in the material and arrangement of the condensate receiving portion, and variations in the ways and methods of affixing the end caps and fastener plate to the walls. Additionally, the amount of slope will vary and the length of the condensate receiving portion will vary. Additionally, clearly the ledge and securing portion could be interchanged with the end cap intrusion and the engagement portion. Additionally, the shapes of the lifting and engagement portions can clearly be modified to other shapes. All such modifications and alterations are intended to fall within the spirit and scope of the claimed invention.

What is desired to be secured for letters patent of the United States is set forth in the following claims.

I claim:

1. A condensate drain pan arrangement with a positive slope comprising:

a housing including a first wall with a first aperture, and a second wall with a second aperture where the first and second walls are spaced;

a coil located in the space in the housing and between the first and second walls;

a drain pan having a condensate receiving portion within the housing and located under the coil, and including a first end cap with a drainage attachment proximal the first aperture and positively engaged to the first wall, and a second end cap proximal the second aperture, the second end cap including an engagement portion and a bottom portion; and an access plate including a lifting portion operably engaged to the bottom portion and raising the bottom portion a predetermined amount sufficient to provide a positive slope from the second end cap towards the first end cap, a securing portion operably engaged with the engagement portion to prevent movement of the second end cap, the second end cap being fixed with relation to the second wall.

2. The condensate drain pan arrangement of claim 1 wherein the engagement portion of the second end cap includes a lateral intrusion extending toward the condensate receiving portion, wherein the securing portion includes a lateral protrusion extending towards the condensate receiving portion.

3. The condensate drain pan arrangement of claim 2 wherein the engagement portion has a broad V shape.

4. The condensate drain pan arrangement of claim 3 wherein the securing portion has a broad V shape.

5. The condensate drain pan arrangement of claim 4 wherein the lifting portion includes a ledge extending from the access plate in a direction towards the condensate receiving portion.

6. The condensate drain pan arrangement of claim 5 wherein the access plate further includes a handle extending from the access plate in a direction away from the condensate receiving portion.

7. The condensate drain pan arrangement of claim 6 further including a final engagement state where the bottom of the second end cap is vertically located above a bottom of the first end cap.

8. The condensate drain pan arrangement of claim 7 further including an initial engagement state wherein the bottom of the second end cap is approximately at the same vertical height as the bottom of the first end cap.

9. The condensate drain pan arrangement of claim 1 further including a final engagement state where the bottom of the second end cap is vertically located above a bottom of the first end cap.

10. The condensate drain pan arrangement of claim 9 further including an initial engagement state wherein the bottom of the second end cap is approximately at the same vertical height as the bottom of the first end cap.

11. A method of installing a drain pan to provide a positive draining slope comprising the steps of:

sliding a drain pan into a housing through a first aperture;

engaging a first end cap of the drain pan to the housing such that the first end cap covers the aperture and secures the drain pan to the housing;

initially engaging an access plate to a second end cap of the drainage pan through a second aperture in the housing;

engaging the access plate with the second end cap in a manner to make the second end caps vertical movements depend upon the access plates vertical movements;

raising the access plate and the second end cap plate as a unit to provide a positive slope to the drain pan; and securing the access plate to the housing so that the access plate blocks the second aperture.

12. The method of claim 11 wherein the vertical securing step includes the further steps of providing a lateral intrusion on the second end cap, providing a lateral extrusion on the first access plate, and operably engaging the end cap intrusion with the access plate extrusion.

13. The method of claim 12 wherein the access plate extrusion is aligned with the end plate intrusion.

14. An access plate comprising:

a vertical face;

a securing portion projecting laterally from the face in a first direction; and a bottom portion projecting from the face in the first direction.

15. The access plate of claim 14 wherein the securing portion has a broad V shape.

16. The access plate of claim 15 wherein the bottom portion has a broad V shape.

17. The access plate of claim 16 further including a handle projecting from the access plate in a second direction opposite the first direction.

* * * * *